US007676866B2

(12) United States Patent
Toms et al.

(10) Patent No.: US 7,676,866 B2
(45) Date of Patent: Mar. 16, 2010

(54) HEIGHT-ADJUSTABLE BEDFRAMES

(75) Inventors: Martin P. Toms, Waterlooville (GB); Ian M. Ryall, Waterlooville (GB)

(73) Assignee: Pegasus Limited (GB)

( * ) Notice: Subject to any disclaimer, the term of this patent is extended or adjusted under 35 U.S.C. 154(b) by 104 days.

(21) Appl. No.: 11/909,569

(22) PCT Filed: Mar. 31, 2006

(86) PCT No.: PCT/GB2006/001186

§ 371 (c)(1),
(2), (4) Date: Sep. 24, 2007

(87) PCT Pub. No.: WO2006/103457

PCT Pub. Date: Oct. 5, 2006

(65) Prior Publication Data

US 2008/0189856 A1 Aug. 14, 2008

(30) Foreign Application Priority Data

Apr. 1, 2005 (GB) ..... 0506691.5

(51) Int. Cl.
*A47B 7/00* (2006.01)
*A47C 27/08* (2006.01)

(52) U.S. Cl. ..... 5/611; 5/424

(58) Field of Classification Search ..... 5/611, 5/424, 600

See application file for complete search history.

(56) References Cited

U.S. PATENT DOCUMENTS

| | | | | |
|---|---|---|---|---|
| 4,403,214 | A | 9/1983 | Wolar | |
| 4,534,077 | A | 8/1985 | Martin | |
| 4,768,241 | A * | 9/1988 | Beney | 5/600 |
| 6,505,365 | B1 * | 1/2003 | Hanson et al. | 5/613 |
| 7,428,760 | B2 * | 9/2008 | McCrimmon | 5/611 |
| 7,472,437 | B2 * | 1/2009 | Riley et al. | 5/600 |
| 2004/0177445 | A1 * | 9/2004 | Osborne et al. | 5/600 |
| 2007/0296600 | A1 * | 12/2007 | Dixon et al. | 340/573.1 |
| 2008/0083065 | A1 * | 4/2008 | Bautovich | 5/424 |

FOREIGN PATENT DOCUMENTS

| | | |
|---|---|---|
| EP | 1 275 328 A | 1/2003 |
| WO | WO 03/070145 A | 8/2003 |

* cited by examiner

*Primary Examiner*—Robert G. Santos
*Assistant Examiner*—Brittany M Wilson
(74) *Attorney, Agent, or Firm*—Craig A. Fieschko, Esq.; DeWitt Ross & Stevens S.C.

(57) ABSTRACT

A bedframe for medical beds has a height-adjustable frame member and an obstruction detector on the height-adjustable frame member. The obstruction detector has a contact member which is displaceable, for obstruction detection, both upwardly and downwardly relative to the frame member. A sensor detects such displacement to stop movement of the frame member. The frame member may be a height adjustable lower frame member of a bedframe having also a height adjustable upper frame member. The bedframe also has a manually removable panel of its headboard and footboard, to allow access to a patient between columns carrying the height-adjustable upper frame member.

25 Claims, 9 Drawing Sheets

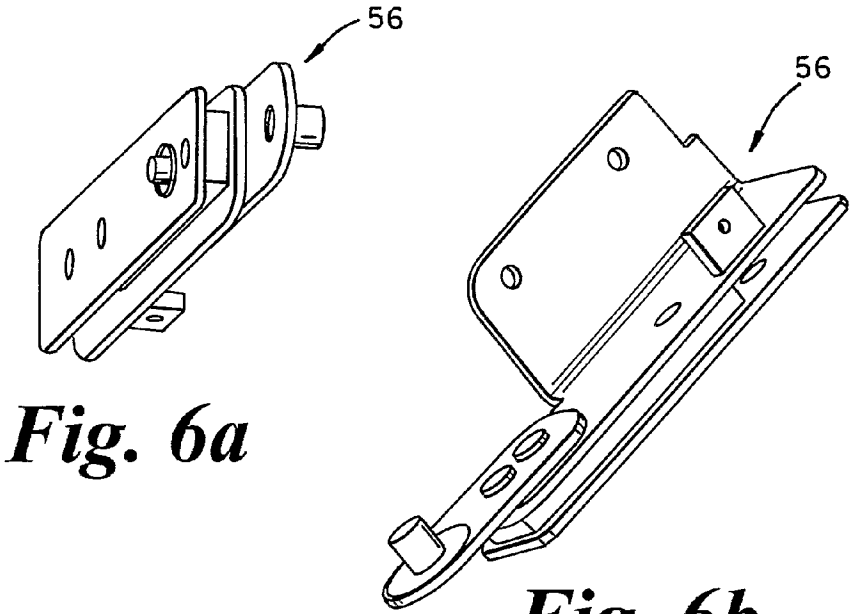
Fig. 6a
Fig. 6b
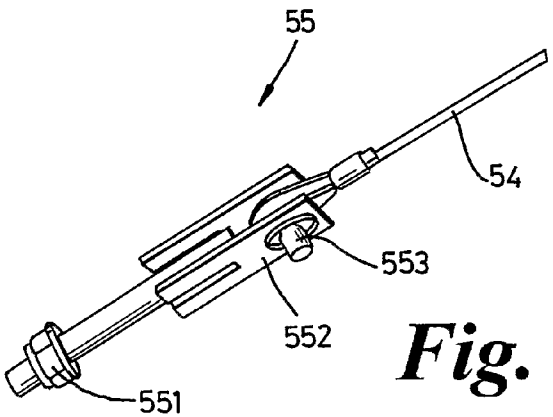
Fig. 6c
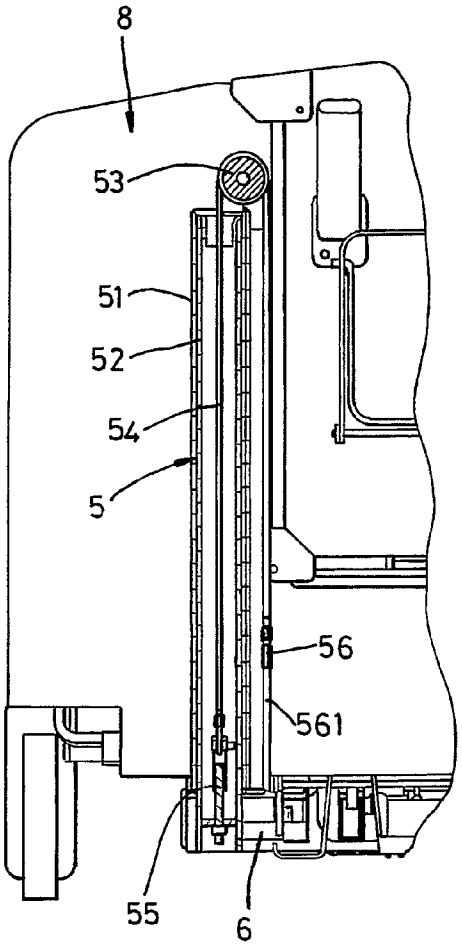
Fig. 5

HEIGHT-ADJUSTABLE BEDFRAMES

FIELD OF THE INVENTION

The present invention relates to height-adjustable bedframes, in particular for height-adjustable beds for medical use.

BACKGROUND OF THE INVENTION

Height-adjustable beds are known in the art, and are commonly used in hospitals and other medical institutions. A frame member of the bed, that supports e.g. a mattress for a patient to lie on, is adjustable in an upward and downward direction. The frame member may be adjustable independently at its head and foot end, in order that the angle of incline of the mattress can be adjusted.

Height-adjustable beds have numerous advantages. For example, the mattress of a height-adjustable bed can be lowered to a position close to the ground. A low mattress position is particularly advantageous for elderly or mentally disabled patients, who are prone to falling out of the bed accidentally or intentionally. The lower the position of the mattress, the less likely it is that a falling patient will be hurt. Furthermore, it is harder for a patient to alight from a mattress positioned close to the ground. However, it is advantageous that the mattress can be raised so that a patient lying on the mattress is at a suitable height for care workers to attend to.

It is desirable that patient care access is provided at the head and/or foot ends of the bed when the mattress is adjusted to any height.

In known height-adjustable beds, the height-adjustable frame member is held at the head and foot end of the bed by respective supports. These supports are often cumbersome, or insufficiently strong to provide a stable platform that will meet the European regulations for hospital bed frames, and comprise powered drive means for raising and lowering the respective ends of the height-adjustable frame member. The supports limit or prevent patient care access from the head and foot ends of the bed. This is a particular problem when certain medical procedures must be carried out on a patient, such as cardiopulmonary resuscitation (CPR). CPR is usually carried out from the head end of a bed, since access to the patient's head is required.

Known height-adjustable beds generally comprise a height-adjustable upper frame member and a fixed lower frame member, the upper frame member being for supporting the mattress and the lower frame member providing rigidity to the bed when the upper frame member is at a raised position. WO01/45626 shows a height-adjustable bed without a lower frame member.

WO03/070145 discloses a height-adjustable bed having both a height adjustable upper frame member and a height-adjustable lower frame member.

However, safety problems arise with beds having height-adjustable frame members. Most notably, it is possible for a person to trap a limb between the height-adjustable parts, e.g. between the upper frame member and the fixed lower frame member during lowering of the upper frame member. WO03/088885 describes obstacle detection devices in such a bed in the form of a wireless curtain, e.g. formed by light beams, or a force-sensing switch.

SUMMARY OF THE INVENTION

One object of the invention is to provide a bedframe having an improved safety against trapping of objects, such as a person's limb, by a height-adjustable member.

Another object of the invention is to provide a bedframe having improved access to the patient on the bed at one or both ends of the bed.

The present invention according to a first aspect provides:

a bedframe having a height-adjustable upper frame member for supporting a patient, the upper frame member being height-adjustable at a foot end and a head end by respective support means;

a first said support means comprising two vertically elongate columns, the columns being spaced from one another in a horizontal direction; wherein over at least part of the height travel of the upper frame member, patient care access is provided through a gap between the columns.

Preferably, the bedframe comprises a manually removable structure, wherein the gap between the columns for patient care access is provided by removal of the manually removable structure.

In this specification the term 'manually' is used to describe removable structures that can be removed by a person without the use of an external tool. The removable structures may be held in guides, e.g. grooves, and may be removed by sliding or lifting in an upward direction.

Preferably the manually removable structure is not part of the structure supporting the upper frame.

Preferably a mattress is provided on the upper frame member. Preferably the bedframe has a generally rectangular shape, appropriate to receiving a standard mattress.

The elongation direction of the bedframe is defined herein as a substantially horizontal direction substantially parallel with the longest side edge of the bedframe. The head and foot ends of the bedframe, and its component parts, are defined herein respectively as the ends adjacent the head and feet of a patient lying on the bed during normal use.

In this specification the term 'patient care access' is used to describe entry for a care worker (e.g. a doctor, nurse, etc.) to a region above the upper frame member, in particular to a region above the mattress, from a region peripheral to the bedframe, the entry being such as to allow normal care procedures to be carried out on the patient by the care worker, most preferably CPR procedures. Preferably the care worker can lean through the space between the two columns of the support, in order to e.g. lean over a patient. Preferably the clear, i.e. unobstructed, space between the two columns for patient care access is between 30 and 200 cm long, more preferably between 40 and 60 cm long, in the horizontal direction, i.e. in the width direction of the bed.

Preferably, the first support means is located at the head end of the bedframe. Preferably, the manually removable structure is a headboard. Preferably, the headboard moves upwards and/or downwards in accordance with height-adjustment of the upper frame member. Preferably, the headboard is manually removably mounted to the support means and/or the upper frame. More preferably, the manually removable structure is a panel which is part of a headboard, the headboard being mounted on the support means and/or the upper frame. Preferably, when the panel is fitted with the remainder of the headboard fixed to the support means and/or the upper frame (i.e. the height-adjustable fixed portion of the headboard), the panel spans the horizontal distance between the two columns. Preferably, the height-adjustable fixed portion of the headboard extends in the region between the columns to a point no higher than the height of a standard mattress located on the upper frame member. Preferably, the panel is slidably fitted to the fixed portion of the headboard.

Removing only a portion, e.g. a panel, of the headboard is easier than removing the entire headboard, as it is lighter.

Furthermore, the fixed portion may serve as a mounting point for medical equipment, electrical connection points, or side rails etc.

Alternatively, the bedframe may comprise no headboard.

The bedframe may comprise a second support means configured similarly to the first support means but located at the opposite end of the bed. The second support frame means, if located at the foot end of the bed, may include a footboard similar to the headboard described above, with a similar manually removable panel, for example.

Preferably each column projects upwardly from a base of the support means, and preferably each column comprises a movable portion, the movable portion being height-adjustable, the upper frame being height-adjustable in accordance with height-adjustment of the movable portion.

Preferably, each column has a respective powered drive means for respectively moving each movable portion. Having separate drive means for each column makes it simpler to provide minimal structure between the columns than if a single drive means were used for both columns. Nevertheless, it is understood that a single drive means could be adapted to move each movable portion, the drive means being configured such that patient care access is available in accordance with present invention. Preferably, each drive means comprises an electric motor.

It is preferable that the drive means of the same support means are synchronised with one another in order that heights of the respective movable portions can be adjusted at the same rate, e.g. with a single actuation step. This prevents the upper frame member tipping to one side during height adjustment, which could cause a patient to fall off a mattress in use.

Preferably, the bedframe comprises a lower frame member, the lower frame member being height-adjustable at a foot end and a head end by the respective support means, the lower frame being located underneath or on the same horizontal plane as the upper frame member. Preferably, upon upward movement of the movable portion of each column, the lower frame member moves upwards at half the speed of the upper frame member, and upon downward movement of the movable portion of each column, the lower frame member moves downwards at half the speed of the upper frame member. It is desirable that the lower frame can be raised from the ground. Preferably, the lower frame can be raised to a position halfway between the upper frame and the ground, in order to maximise bed rigidity. Furthermore, raising the lower frame provides space underneath the bedframe, e.g. for cleaning, and/or for locating X-ray machines, frame members of hoists etc., or even a care worker's feet, whilst the care worker cares for a patient.

Preferably, the lower frame member is fixed in position with respect to the movable portions. More preferably, the lower frame member is fixed to the movable portions.

In order to facilitate the relative movement of the upper and lower frame members as discussed above, i.e. the 2:1 ratio in speeds of the upper and lower frame members respectively, preferably each column comprises a pulley system, the pulley system comprising a cable or chain fixed at one end to the base of the support means and fixed at the other end to the upper frame member. Preferably the cable or chain extends between the base and the upper frame member via a pulley block, the pulley block being mounted on the movable portion.

In this specification the terms "cable" and "chain" are used for simplicity. The terms are intended to cover other flexible, elongate articles, suitable for transferring load, such as ribbons, tapes, ropes, and wires etc.

Preferably, the movable portion of each column is a sleeve such as an outer tube, the outer tube being slidable over an inner tube, the inner tube being fixed with respect to the base of the support means. Preferably the base is a rigid support bar extending between, and preferably beyond, the bottom ends of each column. Preferably a wheel is provided at each end of the support bar, so as to provide means for transporting the bedframe.

Preferably, the upper frame member, lower frame member and support means are configured such that lower frame member rests at the same height as the upper frame member, when the upper and lower frame members are at a minimum height. Preferably, when at a minimum height, the bottom faces of the upper and lower frame members are lower than the top of the wheels.

The present invention according to a second aspect provides:

a bedframe having a height-adjustable member and an obstruction detector for the height-adjustable member, wherein the obstruction detector comprises a contact member displaceably mounted on the height-adjustable member so as to be displaced relative thereto when encountering an obstruction during upward and/or downward movement of the height-adjustable member, and a sensor arranged to detect such displacement of the contact member;

wherein the contact member has upper and lower portions lying respectively above and below the height-adjustable member and is displaceable, for obstruction detection, both upwardly and downwardly relative to the height-adjustable member.

The bedframe of the second aspect of the present invention may have any or all of the features of the bedframe of the first aspect of the present invention set out above, and vice versa.

Preferably, there is a control system arranged so that, when the obstruction detector detects displacement of the contact member, the height-adjustable member is stopped from moving upwards and/or downwards. This provides a safety feature to the bedframe, reducing the risk that a moving portion of the bedframe can trap an obstacle, e.g. the limb of a person. Alternatively, the height-adjustable member may be prevented from moving downwards but not from moving upwards, as this may allow an object trapped by the height-adjustable member to be released.

Preferably the height-adjustable frame member is supported at its foot end and a head end by respective support means.

Preferably the bedframe according to the second aspect comprises a powered drive means for moving the height-adjustable member up and/or down, and preferably the control system is arranged to stop the drive means when the obstruction detector detects an obstruction.

Preferably the height-adjustable member is a lower frame member of the bedframe, the bedframe also comprising an upper frame member. Preferably two or more contact members are provided which, in combination, extend at least the full width and/or length of the lower frame member. Using e.g. two contact members makes transportation of the contact members easier, since they are each smaller than a single contact member that can extend across the same space.

Preferably, both the lower frame member and the upper frame member are height-adjustable, e.g. in the same or a similar manner to the upper frame member and the lower frame member discussed with respect to the first aspect of the present invention. For example, preferably the lower frame member moves upwards and downwards at half the speed of the upper frame member. Preferably, the support means are the same or similar to the support means described with respect to the first aspect of the invention. Nevertheless, known support means, which e.g. provide no such patient care access, may be used.

Preferably the lower frame member comprises two or more beams extending in a direction substantially parallel to the elongation direction of the bedframe, the beams spaced apart in a horizontal direction. Preferably the upper frame member comprises two or more beams extending in a direction substantially parallel to the elongation direction of the bedframe, the beams spaced apart in a horizontal direction. Preferably the beams of the upper frame member support a substantially rectangular mattress support. Preferably, when the upper frame member is in a minimum height position, the beams of the upper frame member lie to one side of the beams of the lower frame member, in a horizontal direction. Such an arrangement means that the minimum height of the upper frame member can be lower than if the upper frame member remained above the lower frame member at all times.

Preferably, the contact member comprises a flange portion that extends to a region directly underneath a beam of the upper frame member, when the upper frame member is in a minimum height position. This enhances safety, as the obstruction detector may detect obstruction directly between a beam of the upper frame member and the floor even if this obstruction is not directly between the lower frame member and the floor.

Preferably the contact member has substantially tubular portions, the tubular portions each comprising first and second side portions, the first and second side portions, in combination with respective upper and lower portions, substantially surrounding the periphery of at least a portion of the beams of the lower frame member. This enhances safety, as it allows the detector to detect obstructions directly between the beams of the lower frame member and the floor, and between the lower frame member and the upper frame member. The tubular portions may have a cross-section that is rectangular, circular or otherwise. The tubular portions need not completely enclose the beams; they may have windows and/or gaps etc.

Preferably, the contact member comprises one or more plate portions that extends between the tubular portions. This enhances safety, as it allows the detector to detect obstruction directly between e.g. the mattress support of the upper frame member and the floor, even if this obstruction is not directly between the beams of the lower frame member and the floor, or the beams of the upper frame member and the floor.

Preferably the sensor is an optical detector. Preferably the optical detector is provided on the inside of a tubular portion. In this position, since the tubular portions may provide a shield, operation of the optical detector is less likely to be affected by external light sources, and the optical detector is less prone to physical damage or accidental operation.

Preferably the optical detector comprises a light transmitter and a receiver. Preferably the transmitter transmits light which is reflected and received by the receiver, when the contact member is not displaced by an obstruction, and which is not reflected and not received by the receiver, when the contact member is displaced by an obstruction. Preferably, when the light is not received, the upper and/or lower frame member is prevented from moving, e.g. by halting power supply to the drive means.

Preferably, an optical detector is provided adjacent each end of each tubular portion.

BRIEF DESCRIPTION OF THE DRAWINGS

Embodiments of the present invention will be described by way of non-limitative example, referring to the drawings. In the drawings:

FIG. 5 shows an enlarged sectional view of a column, of the bedframe of FIGS. 1*a*-1*d;*

FIGS. 6*a* and 6*b* show slide carriages of the pulley system of the bedframe of FIGS. 1*a*-1*d*; and FIG. 6*c* shows the adjustor plate assembly of the pulley system of the bedframe of FIGS. 1*a*-1*d;*

DETAILED DESCRIPTION OF PREFERRED VERSIONS OF THE INVENTION

Figure 1A:
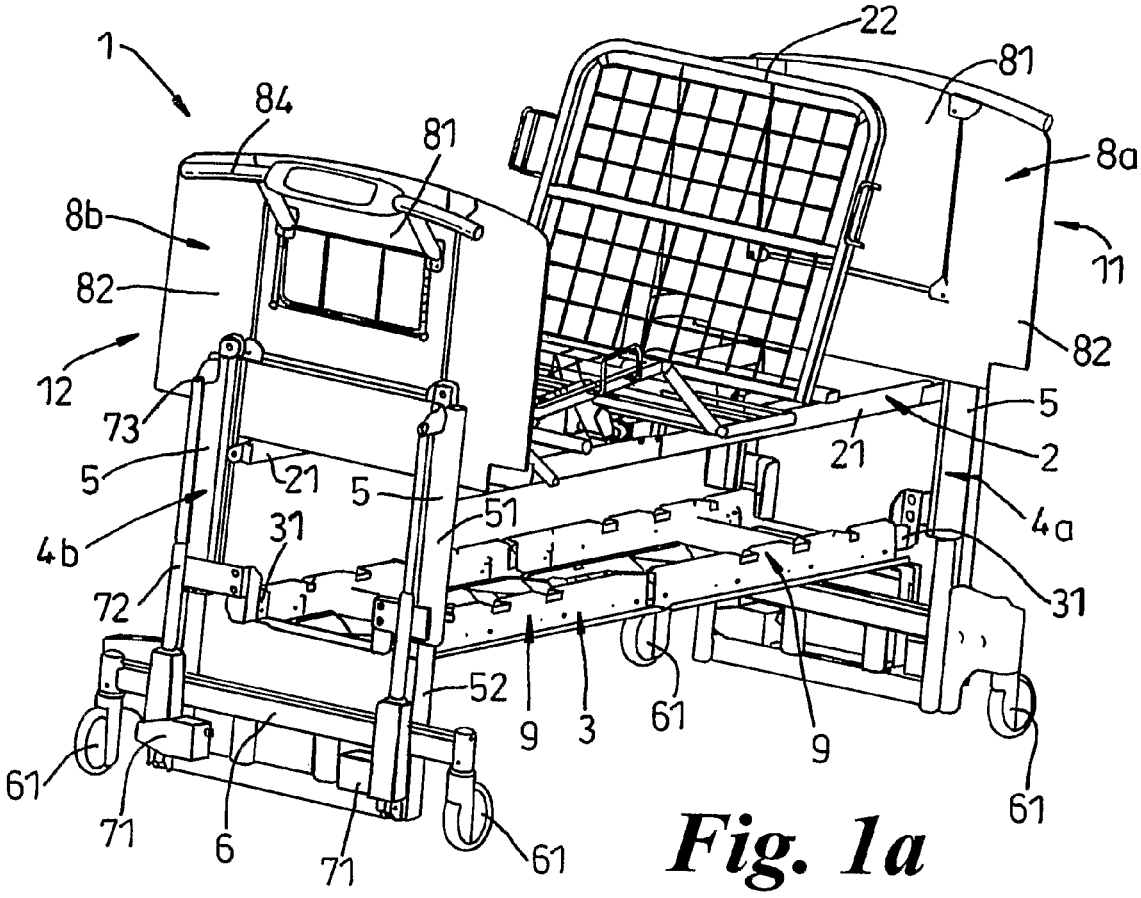
FIGS. 1*a*, 1*b*, 1*c* and 1*d* show an oblique view, foot end view, side view and bottom view respectively of a bedframe according to the present invention with upper frame member in an elevated position.
Figure 1B:
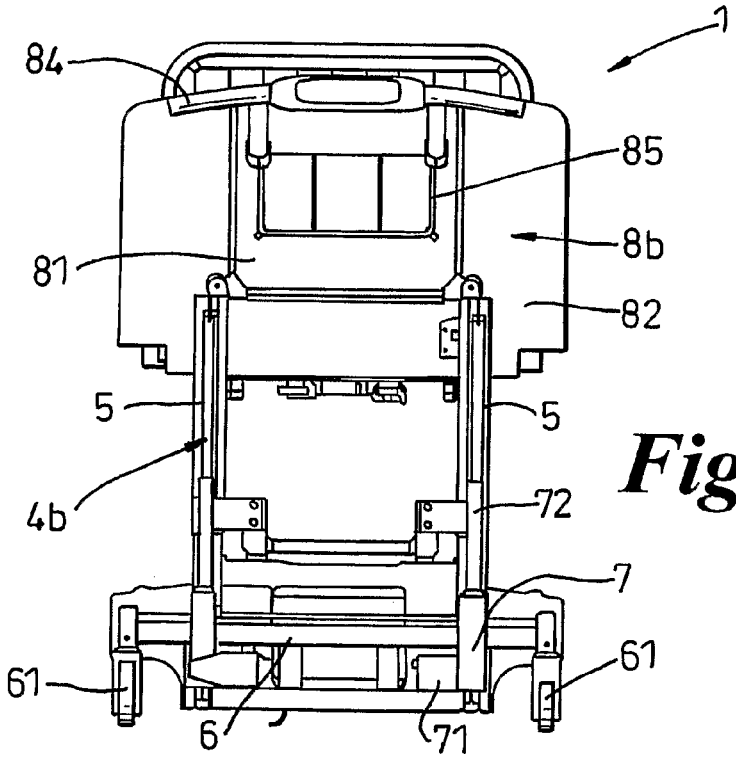
Figure 1C:
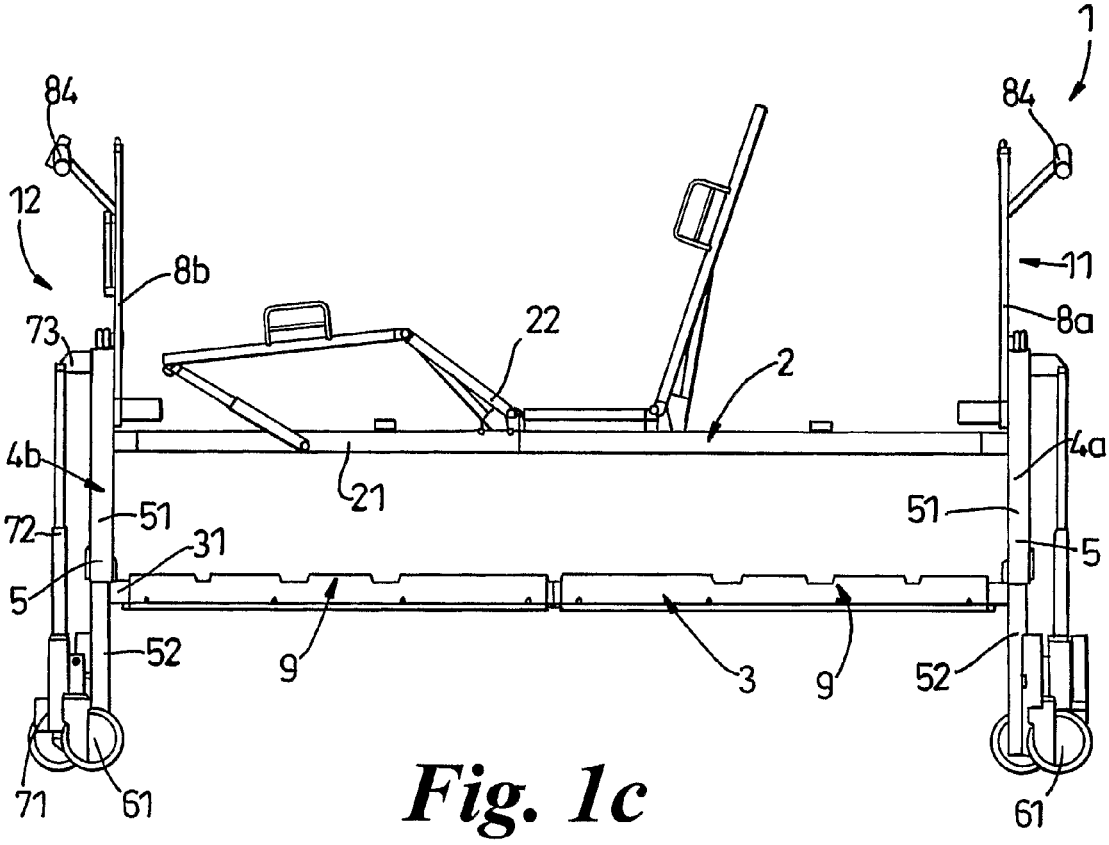
Figure 1D:
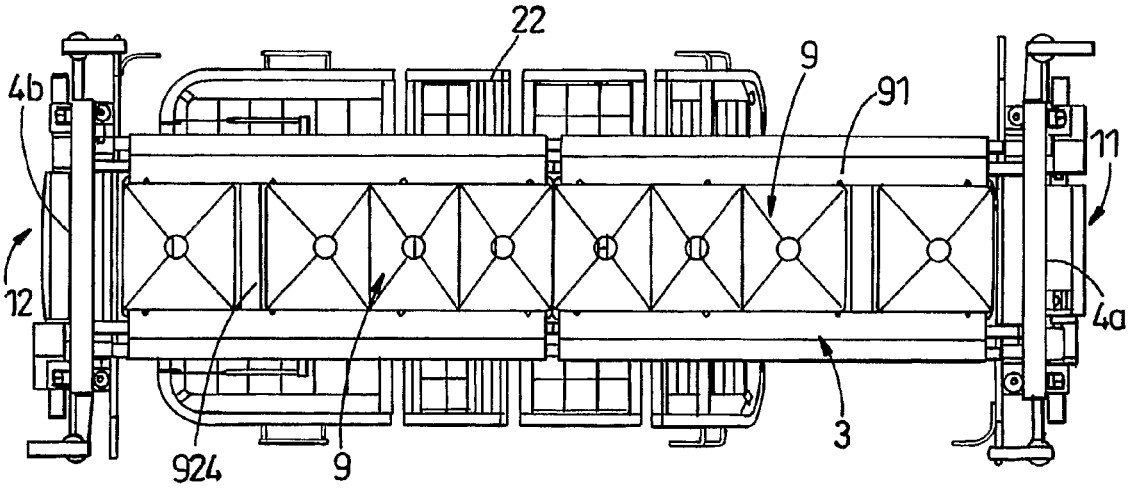
Figure 2A:
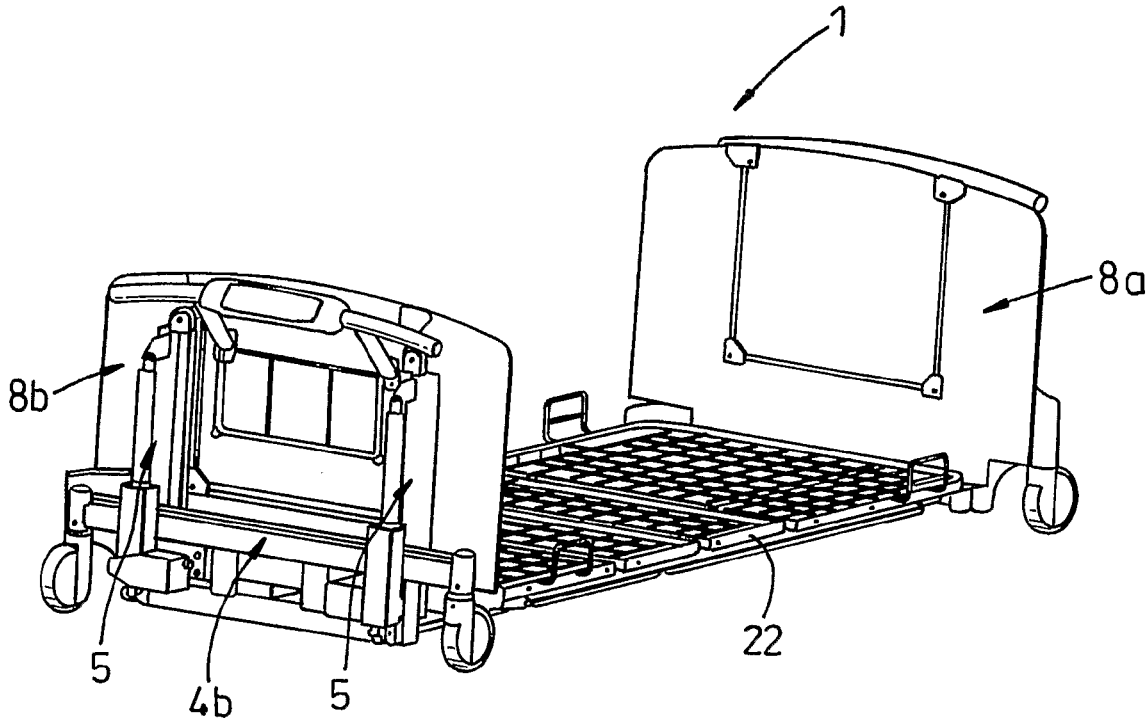
FIGS. 2*a*, 2*b*, 2*c*, 2*d* and 2*e* show an oblique view, foot end view, side view, top view and head end view respectively of the bedframe of FIGS. 1*a*-1*d* with upper frame member in a minimum height position.
Figure 2B:
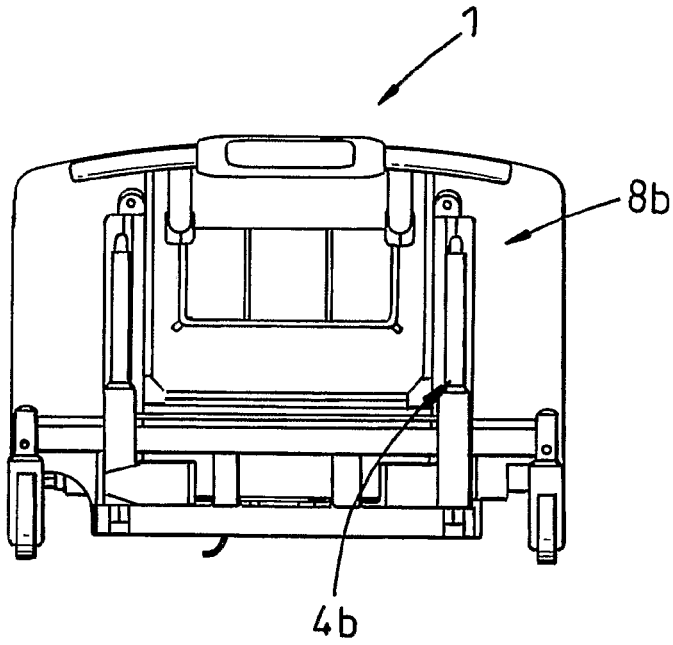
Figure 2C:
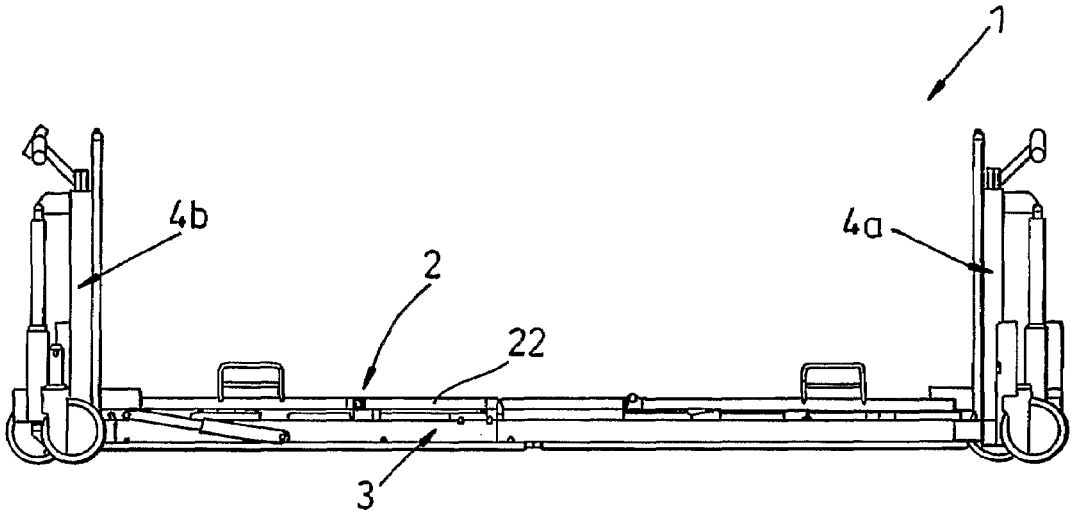
Figure 2D:
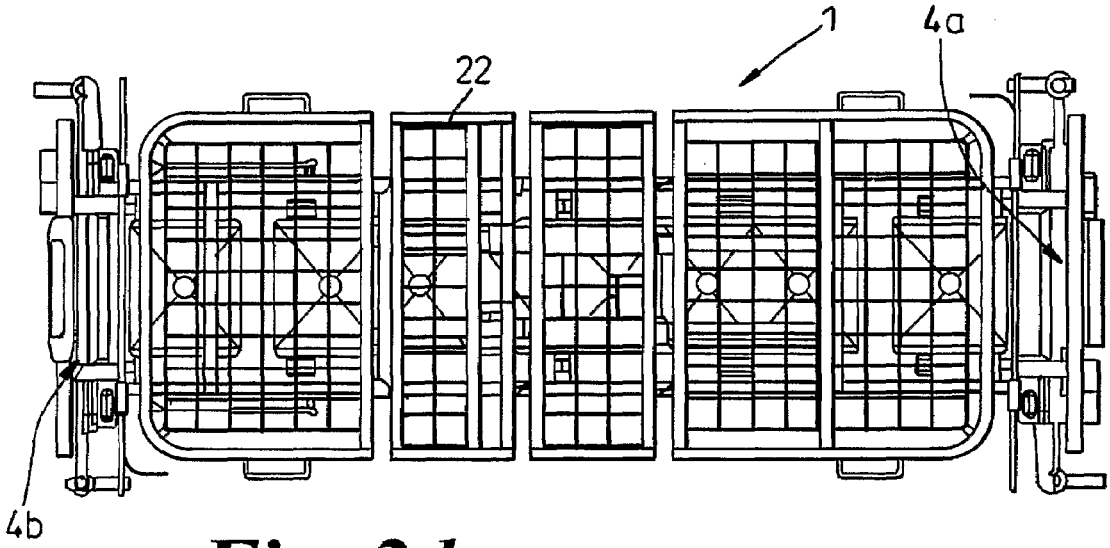
Figure 2E:
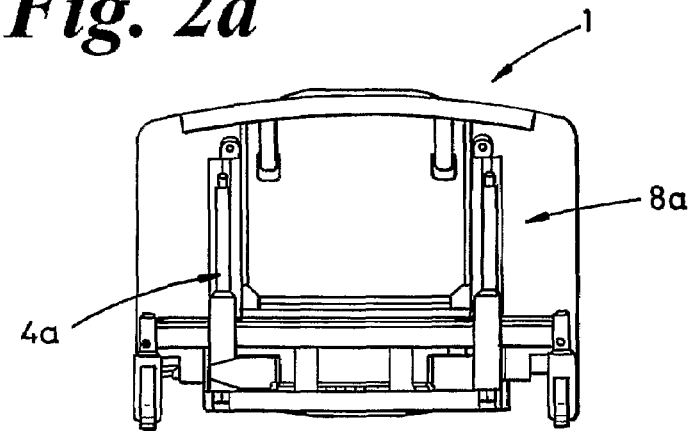

An embodiment of the present invention is shown in FIGS. 1*a*-1*d*. A bedframe 1 is provided, having an upper frame member 2 and a lower frame member 3. The upper and lower frame members 2, 3 are supported at the head end of the bedframe (generally indicated by reference numeral 11) and the foot end of the bedframe (generally indicated by reference numeral 12) by respective head and foot support means 4 (4*a*, 4*b*).

In this specification, terms such as "upper", "lower", "top", "bottom", "side", "inner", "outer", "above", "below", "vertically" and "horizontally" etc. are used for simplicity, in order to describe features of the bedframe 1 as oriented normally during use. In this specification, the term "height" is used to describe the distance, in a vertical direction, of components of the bedframe from the ground during normal use.

The support means 4 (4*a*, 4*b*) each comprise two columns 5, each column 5 extending vertically from respective head and foot base portions 6 mounted on wheels 61. Each column 5 comprises an outer tubular portion 51, which is slidable with respect to an inner tubular portion 52, the inner tubular portion fixed with respect to the base portion 6.

A respective drive means 7 is connected to the outer tubular portion 51 of each column, in order to raise and lower the outer tubular portions. The drive means may be a standard drive means configured for raising and lower bedframe components. In the present embodiment, each drive means 7 comprises an electric motor disposed in a lower housing 71 for driving a telescopic portion 72 of the drive means 7 upwards and downwards. The end 73 of the telescopic portion 72 is fixed to the outer tubular portion 51.

A control means for controlling the drive means 7 is provided (not shown). The drive means 7 of each column are synchronised with one another such that the outer tubular portions 51 of the same support means 4 can be raised and lowered synchronously, e.g. so as to prevent rotation (tipping) of the upper frame member 2 about an axis parallel with the elongation direction of the bedframe 1.

The upper and lower frames 2, 3 are movable from an elevated position, as shown in FIGS. 1*a*-1*d*, to a minimum height position, as shown in FIGS. 2*a*-2*e*. In FIGS. 1*a*-1*d*, the upper frame member 2 is approximately twice the height of the lower frame member 3. Having the lower frame member 3 halfway between the upper frame member 2 and the ground in this manner optimises stability of the bedframe 1. In FIGS. 2*a*-2*e* the upper frame member 2 and the lower frame member 3 are both adjacent the ground. The upper frame member 2 may be raised or lowered as desired to positions in between the positions shown in FIGS. 1*a*-1*d* and 2*a*-2*e*, with the lower frame member 3 moving accordingly.

The upper frame member 2 comprises two beams 21 extending between the head and foot support means 4*a*, 4*b*. The upper frame member 2 further comprises an articulated mattress support 22. A mattress (not shown) is placed on the mattress support 22 to provide a comfortable surface for a patient to lie upon. The mattress support 22 is articulated such that its joints are positioned adjacent a patient's hips and knees, in use. Accordingly, the mattress support 22 can be configured to well known patient support positions e.g. the 'Gatch' position, as shown in FIGS. 1*a*-1*d*, where, in use, a patient is positioned in a sitting state and is so maintained by elevating his knees to prevent his sliding toward the footboard. The mattress support 22 may also be configured to lie flat, for example, as shown in FIGS. 2*a*-2*e*. Articulated mattress supports are known in the art and do not need to be discussed here in any further detail.

Figure 3A:
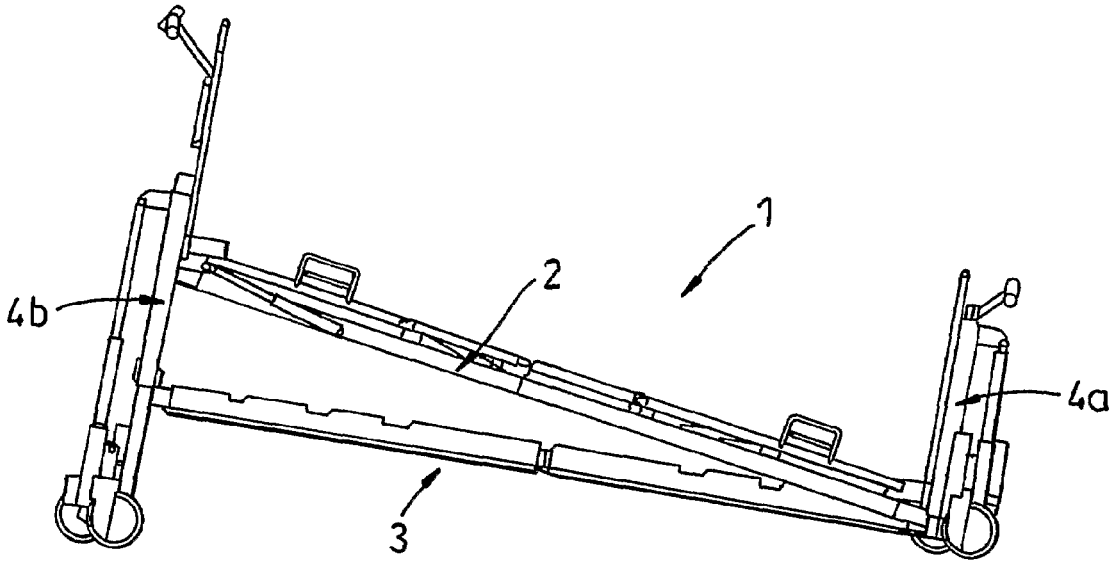
FIGS. 3*a* and 3*b* show a side view and an oblique view respectively of the bedframe of FIGS. 1*a*-1*d* in a Trendelenburg position.
Figure 3B:
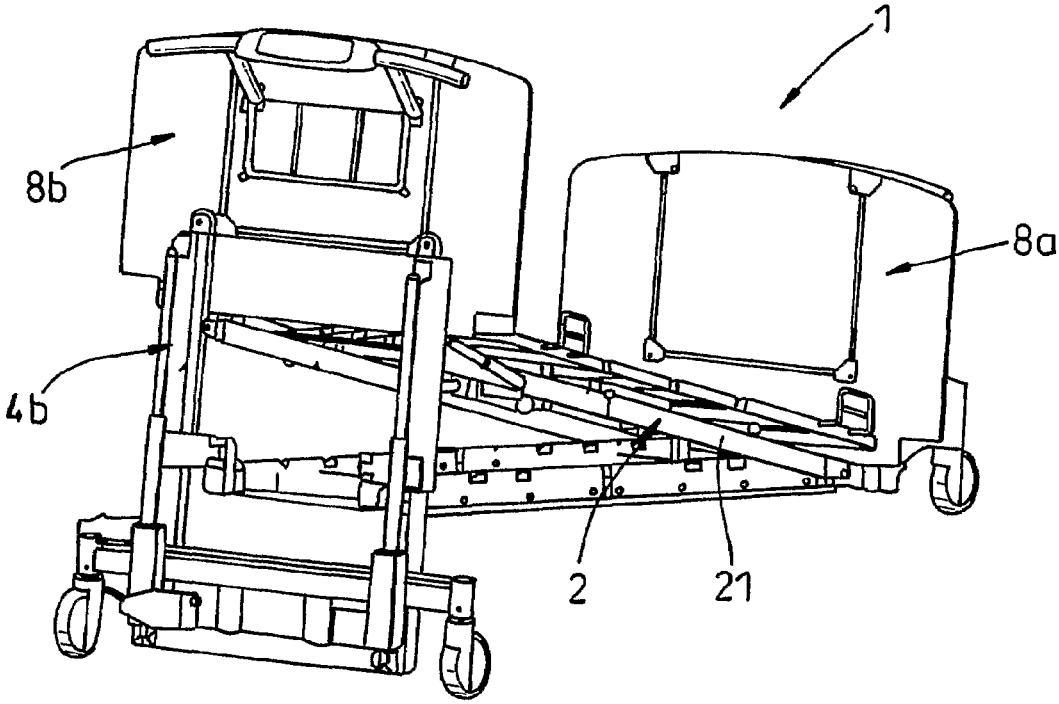

The upper frame member 2 may be positioned in an inclined state, as shown in FIGS. 3*a* and 3*b*. This is possible since the head and foot ends of the upper frame member 2 can be raised and lowered by the respective support means 4*a*, 4*b* independently.

FIGS. 3*a* and 3*b* show the bedframe 1 with the upper frame member 2 in the known "Trendelenburg" position, where the head end of the upper frame member 2 is lower than the foot end. Accordingly, in use, the patient's head is low and the patient's body and legs are on an elevated and inclined plane. The lower frame member 3 is inclined in accordance with the upper frame member 2.

Figure 3C:
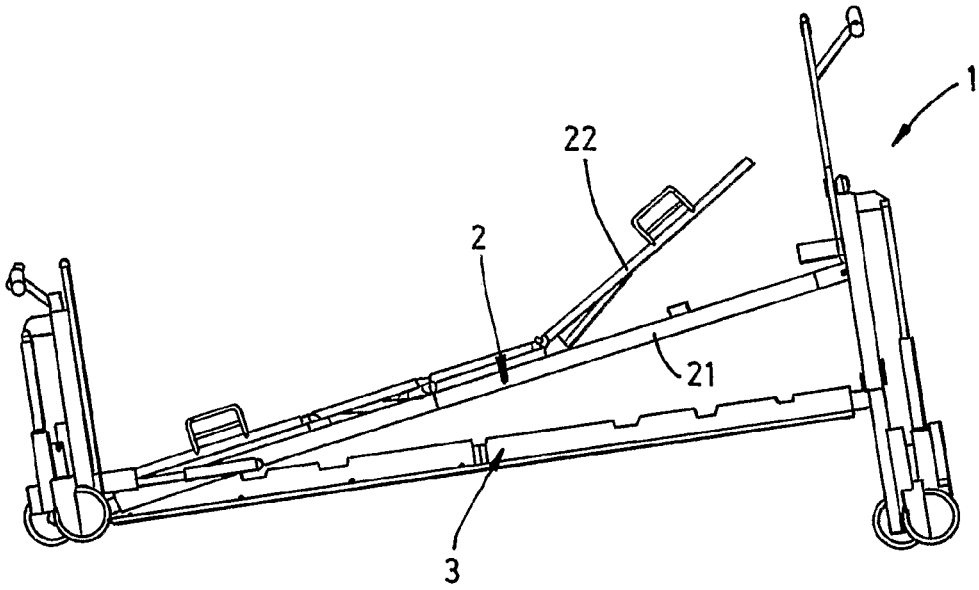
FIGS. 3*c* and 3*d* show a side view and an oblique view respectively of the bedframe of FIGS. 1*a*-1*d* in a reverse Trendelenburg position.
Figure 3D:
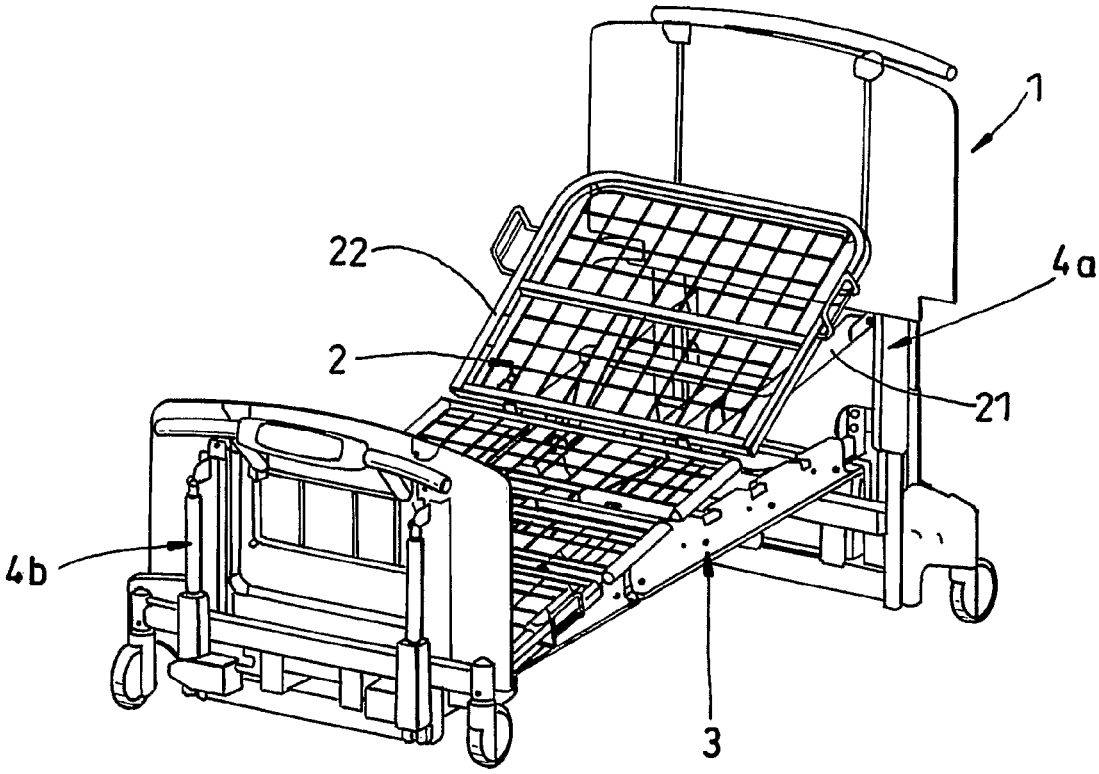

FIGS. 3*c* and 3*d* show the bedframe with the upper frame member 2 in the known "reverse Trendelenburg" position, where the head end of the upper frame member 2 is higher than the foot end of the upper frame member 2. Accordingly, in use, the patient's head is high and the patient's body and legs are on a lowered and downwardly directed plane. The lower frame member 3 is downwardly directed in accordance with the upper frame member 2.

A headboard 8*a* and a footboard 8*b* are fitted to the bedframe 1 at the head and foot ends 11, 12 respectively. The headboard 8*a* and footboard 8*b* are both aligned in standard positions, i.e. in vertical planes perpendicular to the elongation direction of the bedframe. The headboard and footboard are fixed in position with respect to the height-adjustable upper frame member 2.

Figure 4A:
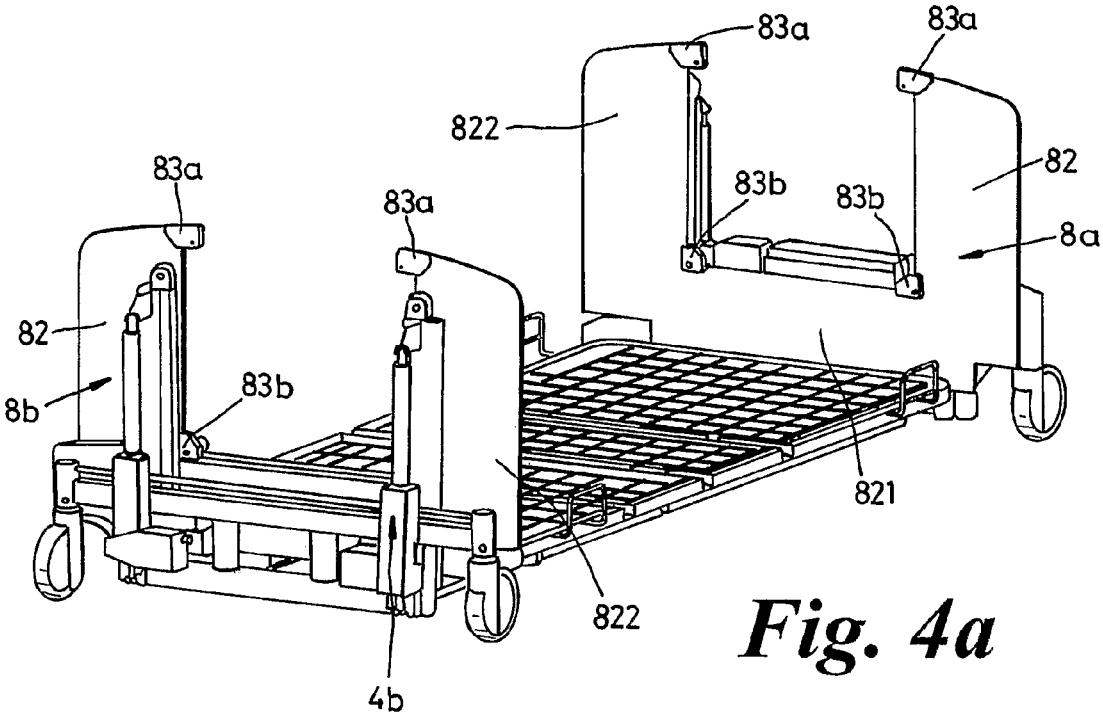
FIGS. 4*a* and 4*b* show oblique views of the bedframe of FIGS. 1*a*-1*d* with the upper frame in a minimum position and in an elevated position respectively and with panels of the headboard and footboard absent.
Figure 4B:
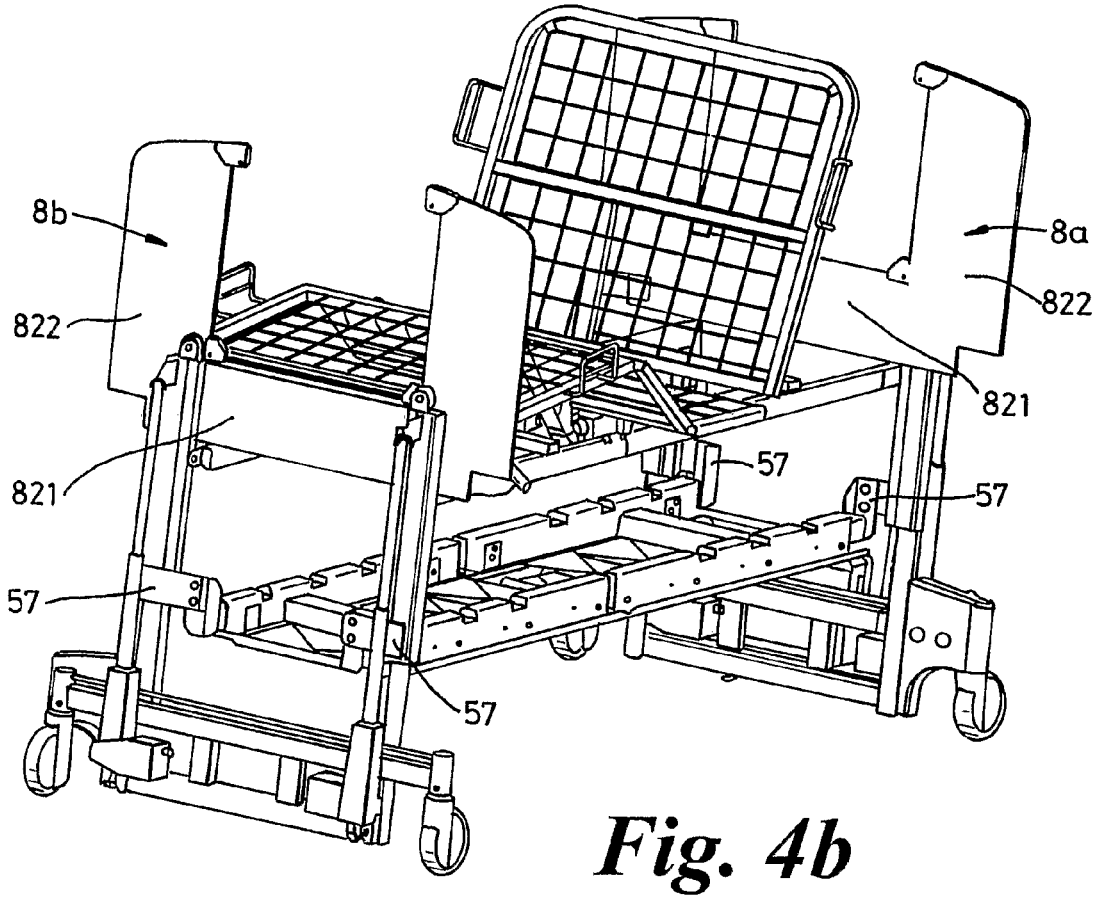

As shown in e.g. FIG. 1*a*, the headboard 8*a* and the footboard 8*b* have a manually removable portion (panel 81). Each panel 81 is slidably fitted to a respective fixed portion 82 of the headboard 8*a* or footboard 8*b*. The fixed portion 82 is generally u-shaped. The panel 81 is aligned between the axes of elongation of the two columns 5 of the respective support means 4*a*, 4*b*. The panel 81 is rectangular and spans the horizontal distance between the two axes of elongation of the columns 5. As shown in FIGS. 4*a* and 4*b*, both panels 81 can be removed entirely from the bedframe 1. This is accomplished by sliding the panels 81 upwards with respect to the respective fixed portions 82. The panels 81 slide in grooves provided by brackets 83*a*, 83*b*.

When the panels 81 are removed, patient care access between the columns 5 is possible between the columns 5 of the head and foot support means 4. For example, CPR may be carried out by a care worker since the care worker can lean through the space between the columns 5 at the head end 11 of the bedframe 1.

Between the columns 5 of each support means 4 a bottom portion 821 of the fixed portions 82 is present, however the bottom portion 821 extends no higher than a standard mattress placed on the mattress support 22. Accordingly, this bottom portion 821 does not significantly reduce the amount of patient care access available.

It is desirable, as is the case in this embodiment, that no cross-member is fixed to, and extends between, the outer tubular portions 51 of the columns 5, of a support means 4, at a height above the lower frame member 3. Although such a cross-member could help to increase the rigidity of the support means 4, it would restrict the amount of patient care access available. However, it is understood that a cross-member could be fixed between the outer tubular portions 51 up to positions halfway up the outer tubular portions 51, with some patient care access still being available.

As shown in FIG. 4*b*, similar patient care access is provided when the upper frame member 2 is in an elevated position.

Side portions 822 of the fixed portions 82 provide useful mounting points for e.g. side rails and electrical connection sockets etc. (not shown).

The headboard 8*a* and footboard 8*b* are both provided with a respective handle 84, to facilitate manual transport of the bedframe, e.g. by rolling the bedframe 1 on the wheels 61, and to assist with manual removal of the panels 81 during e.g. CPR or other care procedures. The footboard 8*b* is provided with a linen tray 85, for holding clean bedclothes.

Although the headboard 8*a* and footboard 8*b* both have manually removable portions (panels 81), it is understood that e.g. the headboard 8*a* only could be provided with a manually removable portion, since patient care access at the foot end 12 of the bedframe 1 generally is not as important as at the head end 11 of the bedframe 1.

The mechanism provided by the columns 5 of the supports 4*a*, 4*b* is now described in detail, with reference to FIG. 5 in particular. Each column 5 comprises a pulley system including a pulley wheel 53, over which passes a cable 54. The cable 54 is fixed at a first end to the base portion 6 of the support via an anchor assembly 55. The anchor assembly 55 is shown in detail in FIG. 6*c*; it comprises a locknut 551, and an adjuster plate 552. The cable 54 is fixed to the adjuster plate via a clevis pin 553. The adjuster plate allows fine-tuning of the position of the anchor assembly 55 from which the cable 54 extends.

The cable 54 extends upwards from the anchor assembly 55 to the pulley wheel 53 through a passage provided by the (hollow) outer and inner tubular portions 51, 52. The cable 54 runs over the pulley wheel and extends downwards. The pulley wheel is rotatably fixed to the top end of the outer tubular portion 51. The second end of the cable 54 is fixed to a slide carriage assembly 56. The end of a beam 21 of the upper frame member 2 is fixed to the slide carriage assembly 56. The slide carriage assembly 56 is slidable in a channel 561 provided in the outer tubular portion 51.

A beam 31 of the lower frame member 3 is fixed to the bottom end of the outer tubular portion 51 via a bracket 57 (see e.g. FIG. 4*b*).

Accordingly, in use, when the drive means 7 raises the outer tubular portion 51, the lower frame member 3 moves upwards at the same rate as the outer tubular portion 51. At the same time, since the upper frame member 2 is fixed to the end of the cable 54 of the pulley system, the upper frame member moves upwards at twice the rate of the lower frame member. Nevertheless, the upper frame member 2 will move upwards stably, since the slide carriage assembly 56 slides in the channel 561 of the outer tubular portion 51, as mentioned above. It will be clear that, with this configuration, when the drive means 7 lowers the outer tubular portion 51, from a high position to a low position, the upper frame member 2 moves downwards at twice the rate of the lower frame member 3. The slide carriage assembly 56 can be either of 'fixed' design, as shown in FIG. 6*b* or of a 'movable' design as shown in FIG. 6*a*. With the 'movable' design, the slide carriage assembly 56 is articulated to allow the upper frame member to achieve the Trendelenberg position in a stable manner, as shown in e.g. FIG. 3*a*. The slide carriage assemblies 56 are either right- or left-handed (not shown in the Figures).

Figure 7A:
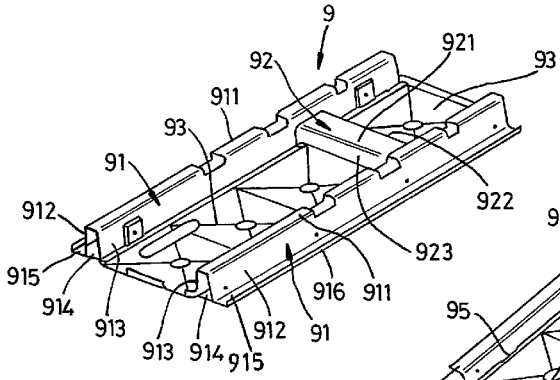
FIGS. 7*a* and 7*b* show, respectively, oblique top and oblique bottom views of the contact member of the bedframe of FIGS. 1*a*-1*d.*
Figure 7B:
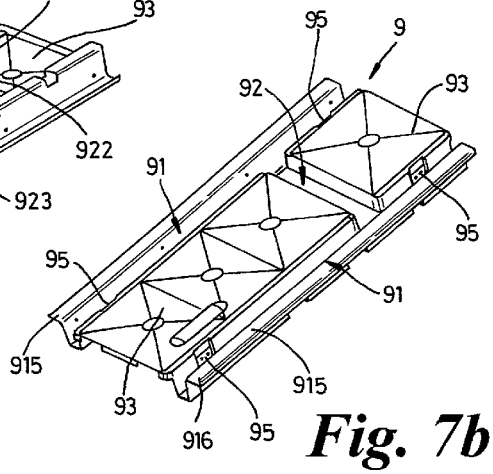

A safety assembly of the bedframe 1 will now be described with reference to FIGS. 7*a*, 7*b*, 8*a* and 8*b*. FIGS. 7*a* and 7*b* show, respectively, a top view and a bottom view of a contact member 9. The contact member comprises two parallel, spaced, elongate main tubular portions 91, each having substantially rectangular cross-sections in a direction perpendicular to their elongation directions. A lateral tubular portion 92 extends between the main tubular portions 91 in a direction perpendicular to the elongation direction of the main tubular portions 91. The main tubular portions 91 each comprise an upper wall 911, an outer side wall 912, an inner side wall 913 and a lower wall 914. The lateral tubular portion 92 comprises an upper wall 921, a first side wall 922, a second side wall 923 and a lower wall 924.

Plate portions 93 extend between the bottom end of the inner side wall 913 of one of the main tubular portions 91 to the bottom end of the inner side wall 913 of the other main tubular portion 91, except where the lateral portion 92 is provided. The plate portions 93 have shallow pyramidal structures formed therein, to increase their strength.

Flange portions 915 extend outwardly, in a horizontal direction, from the outer side wall 912 of each of the main tubular portions 91. Each flange portion 915 has an upwardly projecting lip 916.

Figure 8B:
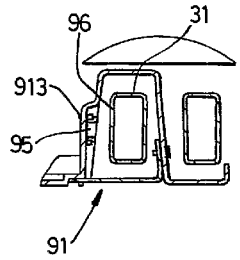
FIG. 8*b* shows an end view of a tubular portion of the contact member with optical sensor attached thereto.
Figure 8A:
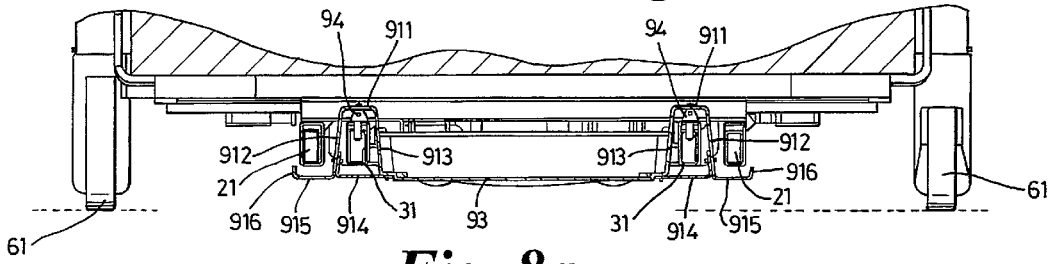
FIG. 8*a* shows an end view of a contact member of the bedframe of FIGS. 1*a*-1*d*.

As can be seen in FIGS. 8*a* and 8*b*, the upper walls 911, 921 and side walls 912, 913, 922, 923 of the main tubular portions 91 and the lateral portion 92, in combination with the flange portions 915 and the plate portions 93, are one-piece, and are formed e.g. by moulding/pressing a single sheet of metal. The lower wall 914 of each of the main tubular portions 91, and the lower wall 924 of the lateral tubular portion 92 are discrete portions that are e.g. screw fitted to elements of the single sheet. This allows the lower walls 914, 924 to be removed (as shown in FIG. 7*b*) in order that the contact members 9 can be fitted easily to beams 31 of the lower frame member 3.

The bedframe 1 comprises two contact members 9, which are mounted on the lower frame member 3 (see e.g. FIG. 1*a*). The lower frame member 3 comprises two parallel, spaced main beams 31 extending between the head and foot support means 4*a*, 4*b*. The lower frame member 3 further comprises two lateral beams extending between the main beams 31, in a direction perpendicular to the elongation direction of the main beams 31, although these lateral beams can not be seen in the Figures due to the positioning of the contact members 9.

In combination, the two contact members 9 surround substantially the entire lengths of the main beams 31 and lateral beams of the lower frame member 3. In particular, the main tubular portions 91 surround substantially the main beams 31 of the lower frame member 3 and the lateral portions 92 surround substantially the lateral beams of the lower frame member 3.

The contact members 9 are displaceably mounted to the lower frame member 3 via a plurality of springs, e.g. conical springs 94 (two of which can be seen in FIG. 8*a*). The springs are fitted between a top side of the main beams 31 and a bottom face of the upper walls 911 of the main tubular portions 91. The springs 94 permit the contact members 9 to be displaced upwardly, downwardly and side-to-side, from rest positions.

In FIG. 8*a*, the upper frame member 2 and the lower frame member 3 are shown in their minimum height position. In this state, the beams 21 of the upper frame member 2 lie to one side of the main beams 31 of the lower frame member 3, in a horizontal direction and the flange portions 915 of the main tube portions 91 lie directly underneath the beams 21 of the upper frame member 2.

A plurality of optical detectors 95 are fixed to the contact members 9 (see FIGS. 7*b* and 8*b*). The optical detectors 95 each comprise a transmitter and receiver, for transmitting and receiving light respectively. The optical detectors 95 are fixed to the inner sidewall 913 of each main tubular portion 91 and each face a respective reflector label 96 located on the main beams 31 of the lower frame member 3.

Each contact member 9 have four optical detectors 95 fixed thereto, one adjacent each end of each main tubular portion 91.

In use, when the contact members 9 are in a rest position, each optical detector transmits a signal, which is reflected by the respective reflector label 96 and received by the optical detector 95. In this state, the drive means 7 may be actuated to raise or lower the upper and lower frame members 2, 3. However, if one or both contact members 9 are displaced substantially, e.g. by an obstruction blocking the path of a the upper and/or lower frame members 2, 3, the transmitted signal from one or more optical detectors 95 will no longer be received by the optical detector 95, since the signal will no longer reflect off the reflector label 96. In this state, the drive means 7 are prevented from raising or lowering the upper and lower frame members 2, 3. Alternatively the drive means are prevented from lowering the upper and lower frame members 2, 3, but not from raising the upper and lower frame members 2, 3, as this may allow an object trapped by the frame members to be released.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A bedframe having a height-adjustable member and an obstruction detector for the height adjustable member, wherein the obstruction detector comprises a contact member displaceably mounted relative to the height adjustable member so as to be displaced when encountering an obstruction during upward and/or downward movement of the height-adjustable member, and a sensor arranged to detect such displacement of the contact member;

wherein the contact member has upper and lower portions lying respectively above and below the height adjustable member and is displaceable, for obstruction detection, both upwardly and downwardly relative to the height-adjustable member.

2. The bedframe according to claim 1 having a powered drive means for moving the height adjustable member up and/or down, and control means arranged to stop the powered drive means when the obstruction detector detects an obstruction.

3. The bedframe according to claim 1, wherein either the contact member extends at least the full lateral width and/or length of the height-adjustable member, or two or more said contact members are provided which, in combination, extend at least the full width and/or length of the height adjustable member.

4. The bedframe according to claim 1, wherein the height-adjustable member is a lower frame member which comprises two or more beams each extending in a direction substantially parallel to the elongation direction of the bedframe, the beams being spaced apart horizontally.

5. The bedframe according to claim 1, comprising a height adjustable upper frame member for supporting a patient, the upper frame member being movable upwards and downwards.

6. The bedframe according to claim 5, wherein the upper frame member comprises two or more beams each extending in a direction substantially parallel to the elongation direction of the bedframe, the beams spaced apart in a horizontal direction.

7. The bedframe according to claim 5 wherein:

a. the height-adjustable member is a lower frame member having two or more beams each extending in a direction oriented at least substantially parallel to the elongation direction of the bedframe, and b. when the upper frame member is in a minimum height position, the beams of the upper frame member lie alongside the beams of the lower frame member, in a horizontal direction.

8. The bedframe according to claim 7, wherein the contact member comprises a flange portion that extends to a region underneath a beam of the upper frame member, when the upper frame member is in a minimum height position.

9. The bedframe according to claim 7, wherein the contact member has substantially tubular portions, the tubular portions each comprising first and second side portions, the first and second side portions, in combination with respective upper and lower portions, substantially surrounding the periphery of at least a portion of respective beams of the lower frame member.

10. The bedframe according to claim 9, wherein the contact member comprises plate portions extending between the tubular portions.

11. The bedframe according to claim 9, wherein an optical detector is provided on the inside of a said tubular member or portion, the optical detector being located on a face of a first or second side portion of a said tubular member or portion such that it opposes a reflector label when the contact member is in a position where it is not displaced by an obstruction, the reflector label being located on the beam of the lower frame member surrounded by the tubular member or portion.

12. The bedframe according to claim 1, wherein the contact member comprises a tubular member at least partially enclosing the height adjustable member.

13. The bedframe according to claim 1, wherein the sensor is an optical detector.

14. The bedframe according to claim 1, wherein the contact member is mounted on one or more springs.

15. The bedframe according to claim 1, wherein the contact member is displaceable, for obstruction detection, in at least two horizontal directions relative to the height adjustable member.

16. The bedframe according to claim 1:

a. wherein the height-adjustable member is a lower frame member, and b. further comprising an upper frame member above the lower frame member, wherein (1) the upper and lower frame members are raisable and lowerable, (2) raising one of the upper and lower frame members automatically raises the other of the upper and lower frame members, (3) lowering one of the upper and lower frame members automatically lowers the other of the upper and lower frame members, and (4) the lower frame member raises or lowers at a slower speed than the upper frame member.

17. The bedframe according to claim 16 wherein the lower frame member raises or lowers at half the speed of the upper frame member.

18. The bedframe according to claim 16 wherein the lower frame member is linked to the upper frame member via a cable.

19. The bedframe according to claim 16 wherein the lower frame member is linked to the upper frame member via a cable riding on a pulley.

20. The bedframe according to claim 1:

a. wherein the height-adjustable member is a lower frame member, and b. further comprising:

(1) a height-adjustable upper frame member above the lower frame member, and (2) spaced support columns adjacent the upper and lower frame members, (3) a headboard extending between the spaced support columns, wherein a portion of the headboard is defined by a manually removable and replaceable panel, the panel being removable to define an open passage between opposing sides of the headboard.

21. The bedframe according to claim 1 wherein the headboard automatically:

a. raises when the upper frame member is raised, and b. lowers when the upper frame member is lowered.

22. The bedframe according to claim 1:

a. wherein the height-adjustable member is a lower frame member, and b. further comprising:

(1) a height-adjustable upper frame member above the lower frame member, and (2) support columns adjacent the upper and lower frame members, with a pair of spaced head end support columns being spaced from a pair of spaced foot end support columns, and (3) a panel extending between one of:

(a) the spaced head end support columns, or (b) the spaced foot end support columns, wherein the panel:

i. moves with the upper frame member as its height is adjusted, and ii. is manually removable and replaceable between the support columns.

23. A bedframe comprising:

a height adjustable upper frame member and a height adjustable lower frame member arranged to simultaneously move upwardly or downwardly, the upper frame member being movable upwardly or downwardly at greater speed than the lower frame member, an obstruction detector for the lower frame member, wherein the obstruction detector comprises a contact member displaceably mounted relative to lower frame member so as to be displaced when encountering an obstruction below the lower frame member during downward movement of the lower frame member, and a sensor arranged to detect such displacement of the contact member.

24. A bedframe including:

a. a height-adjustable member movable upwardly and downwardly within the bedframe, the height-adjustable member including a beam spanning at least a substantial portion of the width and/or length of the bedframe, the beam having opposing beam sides spaced by a beam top;

b. an obstruction detector including:

(1) a contact member having opposing side portions spaced by an upper portion, wherein:

(a) the contact member extends about the beam with its upper portion situated adjacent the beam top and its respective side portions each situated adjacent a respective beam side, and (b) the contact member is biased to have the upper portion of the contact member be elastically respaceable with respect to the beam top;

(2) a sensor detecting displacement of the contact member with respect to the beam of the height-adjustable member.

25. A bedframe including:

a. an upper frame member including an upper frame member beam having a length extending along at least a portion of the width and/or length of the bedframe;

b. a lower frame member including a lower frame member beam having a length extending along at least a portion of the width and/or length of the bedframe;

b. an obstruction detector including:

(1) a tubular contact member wherein one of the frame member beams at least partially rests, the contact member having opposing side portions situated on opposing sides of the frame member beam, wherein the side portions extend both above and below the frame member beam, and wherein the contact member is elastically displaceable with respect to the frame member beam;

(2) a sensor detecting displacement of the contact member with respect to the frame member beam;

wherein at least one of the frame members is movable upwardly and downwardly within the bedframe.

* * * * *